United States Patent [19]

Cottrell et al.

[11] 4,321,068

[45] Mar. 23, 1982

[54] NON-WELDED DISCHARGE ELECTRODE

[75] Inventors: Terence B. F. Cottrell, Walsall; Dennis C. Paddock, Halesowen, both of England

[73] Assignee: Lodge-Cottrell Ltd., Birmingham, England

[21] Appl. No.: 191,800

[22] Filed: Sep. 29, 1980

[30] Foreign Application Priority Data

Oct. 11, 1979 [GB] United Kingdom ..... 35404/79

[51] Int. Cl.[3] ..... B03C 3/04

[52] U.S. Cl. ..... 55/148; 55/151; 29/515; 29/525

[58] Field of Search ..... 55/150–153, 55/154–157, 136–138, 140, 145, 148; 361/225, 226; 403/347; 29/505, 515, 516, 520, 525; 52/667, 669

[56] References Cited

U.S. PATENT DOCUMENTS

| | | | |
|---|---|---|---|
| 180,232 | 7/1876 | Heinz | 52/669 |
| 2,567,709 | 9/1951 | Hedberg | 55/154 |
| 3,039,186 | 6/1962 | Stoyer | 29/520 |
| 3,344,370 | 9/1967 | Sewell | 29/516 |
| 3,350,850 | 11/1967 | Steuernagel | 55/152 |
| 4,126,634 | 11/1978 | Kelichi | 55/152 |

FOREIGN PATENT DOCUMENTS

| | | | |
|---|---|---|---|
| 121928 | 3/1931 | Austria | 55/150 |
| 503495 | 7/1930 | Fed. Rep. of Germany | 55/151 |

*Primary Examiner*—Bernard Nozick

*Attorney, Agent, or Firm*—Daniel Rubin

[57] ABSTRACT

To reduce the cost of construction and avoid alignment problems of its component parts, a non-welded construction of mast discharge electrode, as used in an electro-precipitator, comprises a tube having holes passing transversely therethrough, cross members frictionally secured in said holes, and at least two wires extending parallel to said tube and passing through holes in said cross members, the wires being secured in the holes also by friction. The cross members may be knurled so as to be gripped in the tube holes, the latter preferably being formed by means of a punching operation. The cross members may be crimped frictionally to secure the wires. The provision of a non-welded construction particularly at the wires avoids weakening the wires because of the welding, and distortion arising from the heat of welding. The cross members may alternatively be welded to the tube if desired.

12 Claims, 4 Drawing Figures

NON-WELDED DISCHARGE ELECTRODE

This invention relates to mast discharge electrodes as used in electro-precipitators.

Mast discharge electrodes are used in electro-precipitators in rows between rows of dust collector electrode plate members, the plate members being earthed and the discharge electrodes being charged to a high potential to deposit on the plate members dust from gas flowing between the rows. The mast discharge electrodes may be up to 45 ft. in length and generally extend transversely to the direction of gas flow, i.e. they extend vertically, and, for mechanical strength, may typically take the form of a central tube and parallel wires spaced from the tube on horizontal spacer bars. During construction the tube is drilled to take the spacer bars which are also drilled to take the wires and the whole assembly is welded together, i.e. bars to the tube and wires to the bar.

Not only is such a construction expensive but also difficulties arise in proper alignment of the component parts, in weakening of the wires because of the welding and in distortion arising from the heat of welding.

It is an object of the present invention to obviate or mitigate these difficulties.

The present invention is a method of making a mast discharge electrode comprising forming transverse holes through a tube, inserting cross members in said holes and securing the members in said holes, passing at least two wires through holes in said cross members to extend parallel to said tube, and securing said wires by friction in the holes in the cross members.

The present invention is also a mast discharge electrode comprising a tube having holes passing transversely therethrough, cross members secured in said holes, at least two wires extending parallel to said tube and passing through holes in said cross members, said wires being secured in said holes by friction.

Embodiments of the present invention will now be described, by way of example, with reference to the accompanying drawing, in which.

Figure 1:
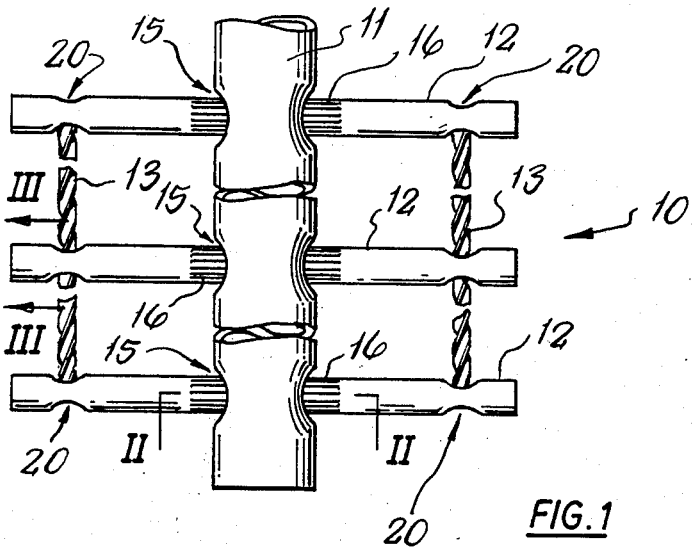
FIG. 1 illustrates a mast discharge electrode according to the present invention.

As indicated in FIG. 1, a mast discharge electrode 10 comprises a vertical central tube 11 from which extend vertically spaced, horizontally extending cross members 12 which in turn support one or more pairs of fabrication wires 13 spaced by the cross members 12 from the tube. The central tube 11 is, in this embodiment, a mild steel continuously welded seamed tube.

Figure 2:
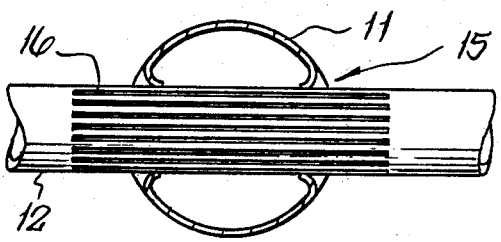
FIG. 2 is a section on the line II—II of FIG. 1.

The cross members 12 are located in position in holes 15 (see FIG. 2) which have been formed in the tube from each side.

Each cross member 12 is provided with raised knurled central portion 16 so that as each cross member is pushed into the holes 15 in the tube, the raised knurled portion 16 engages and bites the edges of the holes and is gripped thereby. This frictional engagement of the cross members 12 in the holes 15 has been found to be perfectly satisfactory, but it is preferred to form the holes 15 by a punching operation, as in the embodiment illustrated, rather than by a drilling operation thereby to increase the area round the hole engaged by the cross member and to take advantage of the natural "C" spring formed by the material.

Each cross member 12 is provided with holes 20 for the wires 13 and it is preferred to form these holes by drilling. In this embodiment the cross members 12 are also tubular and the wires 13 are secured in position in the holes 20 by crimping the tube to bring the edges of the holes into engagement with the wires and so secure the wires in position by friction.

The top cross member is provided with a second set of holes adjacent the holes 20, the top of each wire 13 being formed into a "U" shaped return and secured in a respective one of the second set of holes.

Figure 3:
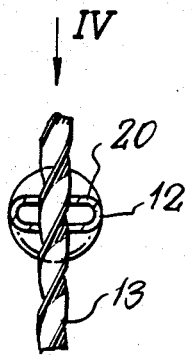
FIG. 3 is a section on the line III—III of FIG. 2.
Figure 4:
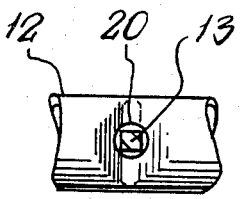
FIG. 4 is a view in the direction of the arrow IV of FIG. 3.

As illustrated in FIGS. 3 and 4, the crimping operation has had the effect of moving a portion of the circular side wall of the cross member from its circumferential position to that of a chord, but any suitable form of crimping may be used.

In a modified embodiment of the invention the cross members 12 are rods, but again the wires 13 are secured in holes in the cross members by a crimping operation.

Alternative crimping operations may be used which either simply squash the cross member onto the wire or which produce a crimp in a direction perpendicular to the wire axis to secure the wire.

In a further modified embodiment the wires are secured in the holes in the cross members by inserting a member into the hole around the wire to wedge the wire peripherally into the hole.

The wires 13 used in the embodiments described are of square cross-section and twisted, and are preferably made of mild or stainless steel.

The tube 11 and cross members 12 may be made of aluminium or stainless steel, and in these cases the invention is particularly useful in view of the difficulties of welding these materials. However, the cross members may be welded to the tube if desired.

We claim:

1. In a method of assembling an electro-precipitator discharge electrode which comprises an elongated mast, a plurality of cross members fixed to the mast and extending transversely thereof, and at least one elongated discharge element extending between the cross members longitudinally of the mast, the improvement comprising the method steps of:

(a) providing the mast with the cross members secured thereto and with apertures extending transversely through the cross members for the reception of the discharge element;

(b) passing the discharge element through the apertures; and (c) fixing the discharge element in the apertures by a direct biting engagement of the material of the cross members around the apertures onto the element.

2. A method according to claim 1, wherein the discharge element is a wire of twisted configuration.

3. A method according to claims 1 or 2, wherein the cross members are tubular.

4. A method according to claim 1, wherein step (a) comprises:

(i) providing apertures extending transversely in the mast for the reception of the cross members;

(ii) passing the cross members through the apertures in the mast; and (iii) fixing the cross members in the apertures in the mast by directly biting the material of the mast around said apertures onto the cross members.

5. A method according to claim 4, wherein the mast is tubular and the apertures therein are formed by punching.

6. A method according to claims 4 or 5, wherein the cross members are each provided with a raised knurled portion about its periphery for the material of the mast to bite onto.

7. In an electro-precipitator discharge electrode including an elongated mast, the improvement comprising:

(a) a plurality of spaced apart cross members fixed to said mast extending transversely thereof and containing apertures defined extending transversely therethrough; and (b) a discharge element extending between said cross members through said apertures longitudinally of said mast and secured in the apertures by direct biting engagement of the material of said cross members around the apertures onto said element.

8. A discharge electrode according to claim 7 wherein said discharge element is a wire of twisted configuration.

9. A discharge electrode according to claims 7 or 8 wherein said cross members are tubular.

10. A discharge electrode according to claims 7 or 8, wherein said mast has a plurality of spaced apart apertures extending transversely therein and said cross members are fixed to said mast by direct biting of the material of said mast around said apertures onto said cross members.

11. A discharge electrode according to claim 10 wherein said cross members each include a knurled portion about its periphery where the material of said mast bites onto said cross members.

12. A discharge electrode according to claims 7 or 8, wherein said cross members extend at right angles to said mast symmetrically on either side of said mast and said discharge element comprises a plurality of discharge elements extending between said cross members parallel to said mast.

* * * * *

UNITED STATES PATENT AND TRADEMARK OFFICE

CERTIFICATE OF CORRECTION

PATENT NO. 4,321,068

DATED March 23, 1982

INVENTOR(S) Terence B.F. Cottrell and Dennis C. Paddock

It is certified that error appears in the above-identified patent and that said Letters Patent are hereby corrected as shown below:

On the cover sheet under [56] "References Cited" "Foreign Patent Documents", add the following:

| | | |
|---|---|---|
| 709635 | 6/1954 | United Kingdom |
| 989024 | 4/1965 | United Kingdom |
| 1016905 | 1/1966 | United Kingdom |
| 1030595 | 5/1966 | United Kingdom |
| 1157602 | 7/1969 | United Kingdom |
| 1231497 | 5/1971 | United Kingdom |
| 1300189 | 12/1972 | United Kingdom |
| 1341580 | 12/1973 | United Kingdom |

Signed and Sealed this

*Twelfth* Day of *March 1985*

[SEAL]

*Attest:*

DONALD J. QUIGG

*Attesting Officer* *Acting Commissioner of Patents and Trademarks*